US010012114B2

(12) United States Patent
Wendelberger

(10) Patent No.: US 10,012,114 B2
(45) Date of Patent: Jul. 3, 2018

(54) METHOD AND DEVICE FOR CONTROLLING A TEMPERATURE OF STEAM FOR A STEAM POWER PLANT

(71) Applicant: Siemens Aktiengesellschaft, Munich (DE)

(72) Inventor: Klaus Wendelberger, St. Leon-Rot (DE)

(73) Assignee: Siemens Aktiengesellschaft, Munich (DE)

( * ) Notice: Subject to any disclaimer, the term of this patent is extended or adjusted under 35 U.S.C. 154(b) by 447 days.

(21) Appl. No.: 14/358,710

(22) PCT Filed: Nov. 16, 2012

(86) PCT No.: PCT/EP2012/072844
§ 371 (c)(1),
(2) Date: May 15, 2014

(87) PCT Pub. No.: WO2013/072464
PCT Pub. Date: May 23, 2013

(65) Prior Publication Data

US 2014/0309798 A1 Oct. 16, 2014

(30) Foreign Application Priority Data

Nov. 17, 2011 (DE) ..... 10 2011 086 562

(51) Int. Cl.
*F01K 21/00* (2006.01)
*F01K 13/02* (2006.01)

(52) U.S. Cl.
CPC ..... *F01K 21/00* (2013.01); *F01K 13/02* (2013.01)

(58) Field of Classification Search
CPC ..... F01K 21/00; F01K 13/02
See application file for complete search history.

(56) References Cited

U.S. PATENT DOCUMENTS 4,027,145 A 5/1977 Kwatny
4,577,270 A * 3/1986 Sugano ..... G05B 13/042 122/448.1

(Continued)

FOREIGN PATENT DOCUMENTS

CN 1202950 A 12/1998
CN 101183246 A 5/2008

(Continued)

OTHER PUBLICATIONS

Marshall et al. "Optimal control of linear multivariable systems with quadratic performance criteria" Aug. 1970 IEE No. 8 vol. 117 pp. 1-9.*

*Primary Examiner* — Charles E Anya
(74) *Attorney, Agent, or Firm* — Beusse Wolter Sanks & Maire

(57) ABSTRACT

A method for controlling a temperature of steam for a steam power plant is provided. A state regulator controls the temperature of the steam at an outlet of a superheater using a feedback of multiple medium states of the steam in the superheater. An aim herein is to achieve a stable and precise control of the steam temperature. This is achieved in that the state regulator is a linear regulator, the feedback matrix of which is ascertained such that the regulator has the control quality of a linear-quadratic regulator.

18 Claims, 3 Drawing Sheets

(56) References Cited

U.S. PATENT DOCUMENTS

| | | | | |
|---|---|---|---|---|
| 4,888,953 | A * | 12/1989 | Fukayama | F01K 13/02 60/646 |
| 7,155,334 | B1 * | 12/2006 | Stewart | F02D 35/023 123/434 |
| 2001/0034560 | A1 * | 10/2001 | Krogmann | G05B 13/027 700/31 |
| 2004/0064297 | A1 * | 4/2004 | Alvarez | G05B 13/04 703/2 |
| 2005/0107895 | A1 * | 5/2005 | Pistikopoulos | G05B 17/02 700/52 |
| 2005/0209714 | A1 * | 9/2005 | Rawlings | G05B 13/048 700/29 |
| 2007/0036253 | A1 * | 2/2007 | Seo | H03L 7/093 375/354 |
| 2009/0198350 | A1 * | 8/2009 | Thiele | G05B 13/042 700/30 |
| 2011/0046752 | A1 * | 2/2011 | Piche | H02J 3/38 700/36 |
| 2011/0125687 | A1 * | 5/2011 | Al-Duwaish | G05B 17/02 706/23 |
| 2012/0072045 | A1 | 3/2012 | Rupp | |
| 2013/0133751 | A1 | 5/2013 | Gadinger | |

FOREIGN PATENT DOCUMENTS

| | | | |
|---|---|---|---|
| DE | 19545520 | A1 | 6/1996 |
| EP | 2244011 | A1 | 10/2010 |
| WO | 2011069700 | A2 | 6/2011 |

* cited by examiner

METHOD AND DEVICE FOR CONTROLLING A TEMPERATURE OF STEAM FOR A STEAM POWER PLANT

CROSS REFERENCE TO RELATED APPLICATIONS

This application is the US National Stage of International Application No. PCT/EP2012/072844 filed Nov. 16, 2012, and claims the benefit thereof. The International Application claims the benefit of German Application No. DE 102011086562.4 filed Nov. 17, 2011. All of the applications are incorporated by reference herein in their entirety.

FIELD OF INVENTION

The invention relates to a method and a device for controlling a temperature of steam for a steam power plant in which a state regulator controls the temperature of the steam at an outlet of a superheater of the steam power plant with feedback of a plurality of medium states of the steam in the superheater.

BACKGROUND OF INVENTION

Steam power stations or steam power plants are widely known, for example from http://de.wikipedia.org/wiki/Dampfkraftwerk (available on Aug. 11, 2012).

A steam power station is a type of power station for generating electricity from fossil fuels, in which a thermal energy from water vapor is converted into kinetic energy in a steam power plant, i.e. usually a multi-part steam turbine, and is further converted into electrical energy in a generator.

In a steam power station of this type, a fuel, for example coal, is burned in a combustion chamber, as a result of which heat is released.

The heat thereby released is absorbed by a steam generator, i.e. in a power station boiler, consisting of an evaporator (part), referred to only as an evaporator for short, and a superheater (part), referred to only as a superheater for short.

In the evaporator, previously cleaned and processed (feed) water which is fed in there is converted into water vapor/high-pressure steam.

Through further heating of the water vapor/high-pressure steam in the superheater, the steam is brought to the temperature necessary for the "consumer", wherein the temperature and specific volume of the steam increase. The steam is superheated by guiding the steam in a plurality of stages through heated tube bundles, referred to as the superheater stages.

The high-pressure steam generated in this way further enters the steam power plant or the—mainly multi-part—steam turbine and there it carries out mechanical work while expanding and cooling.

The efficiency of a steam power station or steam power plant increases with the temperature of the steam generated in the power station boiler or in the steam generator of the steam power station.

However, permissible maximum temperature limits of a boiler tube material supplied with the steam in the boiler and the turbine which is intended to be supplied with the steam must not be exceeded.

However, the more precisely the steam temperature can be held at a desired value, the closer the desired value can be to the permissible steam temperature limit, corresponding to the permissible material-related temperature limit, i.e. a correspondingly higher efficiency can be achieved in the operation of the steam power plant.

The steam temperature is controlled, inter alia, by injecting water into the steam line upstream of the steam generator or upstream of the evaporator and the superheater stages via corresponding injection valves of a spray-type desuperheater.

It is also known for the superheater to have a very inert behavior with its large iron masses. An adjustment of the injection valve—and therefore the injected water quantity—has an effect only after several minutes on the steam temperature that is to be controlled.

The time delay in the modification of the steam temperature is not constant, but depends on the current steam mass flow rate.

In addition, the steam temperature to be controlled is strongly influenced by numerous disturbances, such as e.g. load changes, soot blowing in the boiler, change of fuel, etc.

A precise temperature control of the steam is difficult to achieve for these reasons.

To solve this problem, i.e. for a precise and reliable control of the steam temperature, a so-called cascade control for the steam temperature is known.

With this cascade control, two interleaved PI control circuits are set up. An outer, slow PI controller controls the steam temperature at the superheater outlet and specifies a desired value for the steam temperature at the superheater inlet (manipulated variable of the outer, slower control circuit), i.e. following the injection.

With this desired value for the steam temperature at the superheater inlet, steam temperature is controlled at the superheater inlet by an inner, fast PI controller (inner, faster control circuit) which adjusts the injection valve (manipulated variable of the inner, fast control circuit).

Disturbances of the steam temperature at the inlet of the injection can be quickly compensated with this cascade control. The disadvantage of the cascade control is that disturbances which affect the superheater itself can be compensated in the outer, slow circuit only, i.e. with low control quality.

A two-circuit control, which is constructed with a structure identical to that of the cascade control with an outer and inner control circuit, provides a further solution to the problem of a precise and reliable steam temperature control.

However, in comparison with the cascade control having the outer, slower and the inner, faster control circuit, the outer control circuit in the two-circuit control is replaced by a computing circuit.

The desired value for the temperature at the super heater inlet is then calculated by means of the computing circuit in each case on the basis of a superheater model and water/steam table relations so that the required temperature is set at the superheater outlet.

The computing circuit can additionally be provided with differentiating elements which allow an early response to disturbances affecting the superheater.

The disadvantage of the two-circuit control is that a very large amount of time is required for an identification of parameters for the superheater model during a commissioning of the steam power plant.

In EP 2 244 011 A1, a state control is proposed for the steam temperature control problem in the outer control circuit of the cascade or two-circuit control.

In this state control, the temperature of the steam is controlled at the outlet of the superheater with feedback of a plurality of partially non-measurable (medium) states of the steam in the superheater in order to determine a controller setting signal (desired value for the superheater inlet temperature).

However, since this plurality of steam states in the superheater which are used in an algorithm of the state control are not measurable, an observer circuit is required with which the required states are estimated.

The advantage of this state control is that it enables a very fast and accurate response to disturbances affecting the superheater.

However, such an algorithm of the state control responds highly sensitively to changes in a dynamic behavior of a control path in the state control. Although very good control results are achieved e.g. in a load point of the steam power plant, only an insufficient control behavior is achieved under changed operating conditions of the steam power plant.

To solve this problem, EP 2 244 011 A1 then further provides a Linear Quadratic Regulator (LQR) in the state control. This, i.e. the LQR, is a state regulator whose parameters are determined in such a way that a quality criterion is optimized for the control quality.

The quality criterion for the linear quadratic regulation also takes account of the relationship of the parameters, the manipulated variable u and the controlled variable y, wherein the priorities are determined by the $Q_y$ and R matrix. The quality value J is determined according to:

$$J(x_0,u(t))=\int_0^\infty (y'(t)Q_y y(t)+u'(t)Ru(t)dt.$$

The static optimization problem for this, which is solved by the linear quadratic regulation, reads (with K as the regulator matrix and $x_0$ as the initial state):

$$\min_{u\{t\}} J(x_0, u(t)) = \min_{u\{t\}=-Kx\{t\}} J(x_0, u(t)) = \min_{K} J(x_0, -Kx(t)).$$

In EP 2 244 011 A1, a Kalman filter, which is similarly designed according to the LQR principle, is used as an observer. The interplay of the LQR with the Kalman filter is referred to as the LQG (Linear Quadratic Gaussian) algorithm.

However, the LQG method used according to EP 2 244 011 A1 relates to linear regulation problems, whereas the injection mass flow, as the final manipulated variable of the inner control circuit, acts in a non-linear manner on the temperature controlled variable.

Through a consistent conversion—furthermore also provided according to EP 2 244 011 A1—of all temperature measurement values and desired temperature values into enthalpies, a linearization of the regulation problem is achieved, since a linear relation exists between the injection mass flow and the steam enthalpy. The conversion of temperature into enthalpy is effected here by means of corresponding water/steam table relations using a measured steam pressure.

Through this linearization in EP 2 244 011 A1, a very robust control behavior is achieved, i.e. the control quality no longer depends on the current operating point of the steam power plant.

The calculation of a feedback matrix in the state regulator (regulator matrix) and also the corresponding feedback matrix in the observer (observer matrix), correspondingly constructed according to the LQR principle of the state regulator, by which the regulator is finally represented, is carried out continuously online in EP 2 244 011 A1, in each case using current measurement values.

The regulator in EP 2 244 011 A1 thus adapts continuously to the actual operating conditions of the steam power plant. For example, a load-dependent change in the dynamic superheater behavior is thereby automatically taken into account.

An increase in the robustness of the control algorithm is thus achieved in EP 2 244 011 A1 through this online calculation of the feedback matrix.

Disturbances directly affecting the superheater are expressed in that a temperature rise, i.e. a relation of the enthalpies between the superheater outlet and inlet, changes.

EP 2 244 011 A1 therefore provides here that not only the states or the temperatures along the superheater are estimated, but additionally the disturbance or a disturbance parameter is defined as a further state and is estimated using the observer.

A very fast, accurate but simultaneously robust response to corresponding disturbances is thus possible.

Due to the fact that this control algorithm according to EP 2 244 011 A1 is very robust due to the described measures (linearization, online calculation, disturbance parameter estimation), only very few parameters need to be set during the commissioning of a steam power plant. The commissioning time and cost are therefore substantially reduced.

However, the state control constructed in this way with LQG, i.e. with a state regulator and observer according to the LQR principle, according to EP 2 244 011 A1, also has various disadvantages.

The online calculation of the regulator and observer matrix is associated with a very substantial computing time and storage space requirement. It can therefore no longer run simultaneously with other automation functions on a standard automation processor.

It is thus necessary to provide additional automation processors which are, however, very expensive, or to use one or more separate PC modules, which are coupled into a control technology system of the steam power station.

This applies particularly in view of the fact that calculations of this type must be carried out for each individual steam temperature control circuit (e.g. around 20 circuits in a large coal-fired power plant).

The use of LQG control, as proposed according to EP 2 244 011 A1, is therefore associated with an additional cost for the hardware and corresponding spare parts procurement.

Although the observation of the heat flow as a disturbance parameter acting on the superheater is advantageous, it cannot overcome the difficulty that the regulator responds to changes in the fuel mass flow only when this control intervention has already taken effect on the steam temperature at the superheater outlet.

In parallel with the LQG regulator, a derivative element must therefore be used which ensures that when the fuel mass flow is adjusted, the injection mass flow is simultaneously adjusted, so that the effect on the steam temperature can be minimized.

A derivative element of this type must be parameterized in plant tests, which is a time-consuming and costly process.

SUMMARY OF INVENTION

An object of the invention is to indicate a steam temperature control for a steam power plant which controls the steam temperature both precisely and stably, and which can be implemented and used in a low cost and time-efficient manner.

These objects are achieved by a method and a device for controlling a temperature of steam for a steam power plant according to the respective independent patent claim.

The device according to the invention is particularly suitable for carrying out the method according to the invention or one of its developments explained below, and the method according to the invention is particularly suitable for being carried out on the device according to the invention or one of its developments explained below.

Preferred developments of the invention can also be found in the dependent claims. The developments relate to both the method according to the invention and the device according to the invention.

The invention and the described developments can be implemented in both software and hardware, for example using a specific electrical circuit or a (computing) module.

Furthermore, the invention or a described development can be implemented by means of a computer-readable storage medium on which a computer program is stored which executes the invention or the development.

The invention and/or each described development can also be implemented by means of a computer program product which has a storage medium on which a computer program is stored which executes the invention.

In the method according to the invention for controlling a temperature of steam for a steam power plant, a state regulator controls the temperature of the steam at an outlet of a superheater with feedback of a plurality of medium states of the steam in the superheater, for example described via temperatures or enthalpies of the steam along the superheater.

In the device according to the invention for controlling a temperature of steam for a steam power plant, a state regulator is provided which controls the temperature of the steam at an outlet of a superheater with feedback of a plurality of medium states, for example described via temperatures or enthalpies of the steam in the superheater.

In order to achieve a stable and precise control of the steam temperature, the invention furthermore provides that the state regulator is a linear regulator whose feedback matrix is determined in such a way that it has the control quality of a linear quadratic regulator.

In other words, the invention is initially based on a linear quadratic regulator for the state control.

A linear quadratic regulator (LQR) of this type is a (state) regulator whose parameters can be determined in such a way that a quality criterion is optimized for the control quality. A precise and stable control can thereby be achieved.

In order to calculate the regulator matrix, the feedback matrix of the state control can then be transferred into a set of scalar equations, referred to as matrix Riccati equations.

As a result, "mathematical (computing) modules" can advantageously be kept simple.

These matrix Riccati equations are derived from linear quadratic optimal control problems on a continuous, unilaterally unlimited time interval if these problems are tackled, as here, using a "feedback" approach, i.e. with a (state) feedback.

This set of scalar equations or the matrix Riccati equations of the originally linear quadratic regulator can then be simplified in an analytically solvable manner by leaving out quadratic terms.

This means that the matrix Riccati equations of the original linear quadratic regulator can be simplified by ignoring quadratic terms, in particular all quadratic terms in the equation system.

Expressed in a clear and simplified manner, the originally linear quadratic regulator thus becomes a "linear" regulator through this modification or simplification, wherein the "linear" regulator (still) has the control quality of the linear quadratic regulator.

The calculation of the regulator matrix of this "linear" regulator is then analytically possible with simple calculations, without iterations or integrations, as a result of which the cost incurred in calculating its regulator matrix can be substantially reduced, i.e. by around 75%.

In other words, regulator amplifications in the "modified or linear" state regulator can then be determined analytically simply and with substantially reduced computing cost, by solving the simplified set of scalar equations or the simplified matrix Riccati equations.

Due to the specific structure of system matrices in the selected model for the steam temperature control and of value ranges of (system) parameters contained therein, this simplification, i.e. the leaving out of the quadratic terms from the set of scalar equations or from the matrix Riccati equations, entails only few inaccuracies.

The advantages that a linear quadratic regulator offers, i.e. its control quality, its robustness and the low commissioning cost, continue to apply without restriction to the modified, new linear regulator also.

However, additional, new advantages are also provided by the invention.

Thus, computing time and storage requirements are reduced by the invention, the need for additional automation processors or specific modules is eliminated, as otherwise required in complex calculations through integration and iteration. The invention therefore also enables a clear cost reduction.

Due to the simpler structure of the linear regulator, its new algorithm is also easy to maintain and extend, particularly in the case of a modified state calculation/estimation in the state control, for example as in an exchange of the disturbance parameter observer with a parameter observer.

Since the fed back medium states of the state control, in particular temperatures or enthalpies of the steam along the superheater, are not measurable, the plurality of medium states of the steam can be determined or "estimated" by means of an observer, in particular by means of an observer which operates independently from the state regulator.

The terms "estimate", "calculate" and "determine" are used below as synonyms in connection with the observer.

The advantage of this "observer concept" is that a very fast and accurate response to disturbances affecting the evaporator is possible.

If the state regulator is thus understood as a control circuit which controls the controlled variable on the basis of a state space representation, the state of the control path is fed, i.e. fed back, by the observer to the control path.

The feedback, which, together with the control path, forms the control circuit, is effected by the observer, which replaces a measuring device, and the actual state regulator.

The observer calculates the states of the system, in this case of the steam in and along the superheater.

The observer comprises a state differential equation, an output equation and an observer vector. The output of the observer is compared with the output of the control path. The difference acts via the observer vector on the state differential equation.

In one advantageous embodiment of the invention, the observer is a Kalman filter which is designed for the linear quadratic or linear state feedback. The interplay of the simplified/modified linear quadratic, i.e. the linear, regulator with the Kalman filter is referred to as the LQG (Linear Quadratic Gaussian) algorithm.

It can then also be appropriately provided that identical values are used for observer amplifications of the observer for the plurality of medium states.

In other words, in order to calculate the observer matrix, it can initially be assumed that identical values can be used for the observer amplifications of the states which describe, for example, the temperatures or enthalpies along the superheater.

Instead of having to calculate a plurality of "state observer amplifications", only one associated amplification thus needs to be determined.

The cost incurred in calculating an observer matrix simplified to this extent can thus be substantially reduced.

Furthermore, approximation functions/curves can be used which describe the dependence of the individual observer amplifications on the various parameters. These approximation functions/curves can appropriately be determined offline in order to then use these approximations online.

These dependences can be represented with sufficiently high precision by using linear, power and root functions.

According to one development, it can be provided that, in order to determine approximation functions of this type, the observer amplifications can be solved (precisely) offline by solving the matrix Riccati equation. These precise functions/curves for the observer amplifications are then mapped/simulated by simple analytical approximations (linear, power and/or root functions). These approximations are then used online for observer amplifications.

In total, the cost of calculating the observer matrix can thus be reduced by around 95%.

According to a further preferred development, the state regulator can be equipped with a parameter observation.

This parameter observation can be integrated into the state observer, i.e. the observer "observes" or estimates not only the (fed back) states, but also this parameter.

In this parameter observation, a combustion parameter, for example a heat transfer factor, can be "observed" which describes the proportion of a total fuel power that is actually used to heat the steam flowing through the superheater. In other words, the parameter also observed or estimated by the observer also may be the combustion parameter or the heat transfer factor.

With simplification of the common observer matrix through identical observer amplifications for the states, only two different observer amplifications, i.e. one for the states and a second for the combustion parameter, are thus to be determined here in the case of an observer for the states and the combustion parameter, as a result of which the cost of calculating the observer matrix is substantially reduced.

This procedure for the parameter observation, i.e. the use of a parameter observer instead of a disturbance parameter observer as in the case of EP 2 244 011 A1, results in a significant increase in the control quality in the case of changes in the fuel mass flow and, particularly in the case of load ramps, a changing fuel mass flow impacts directly on the (steam) temperature controller.

In the event of fuel mass flow changes, the controller thus adjusts the injection mass flow directly also, even before the steam temperature at the superheater outlet begins to change at all.

In this way, even an optimum pilot control in terms of the mathematical model used is obtained, for the commissioning of which no cost whatsoever is incurred.

The observation of other disturbances, e.g. in the case of soot blowing, fuel changes and the like, is in no way restricted with the new structure.

A further advantageous design of the invention provides that enthalpies of the steam, in particular deviations of the absolute enthalpies from the desired enthalpy values, are used as state variables.

Through the use of the enthalpies instead of steam temperatures, the control system can be linearized and can thereby be made accessible to a simpler calculation.

The LQR method relates to linear control problems. However, due to the absorption of heat in a non-linear manner, the temperature at the inlet into the evaporator affects the temperature controlled variable at the outlet.

Through consistent conversion, in particular of all temperature measurement values and desired temperature values into enthalpies, a linearization of the control problem is achieved, since a linear relation exists between the inlet and outlet enthalpies.

The conversion is appropriately carried out by means of corresponding water/steam table relations using the measured steam pressure.

Through this linearization, a very robust control behavior is achieved, i.e. the control quality no longer depends on the current operating point of the steam power plant.

Furthermore, it can also be provided that the calculation of the feedback matrix in the state regulator (regulator matrix) and also the corresponding feedback matrix in the observer (observer matrix), correspondingly constructed according to the LQR principle of the state regulator, is carried out continuously online, in each case using current measurement values.

The regulator thus adapts continuously to the actual operating conditions of the steam power plant. For example, a load-dependent change in the dynamic superheater behavior is thereby automatically taken into account.

Due to this online calculation of the feedback matrix, an increase in the robustness of the control algorithm is thus achieved.

The feedback matrix is advantageously calculated by means of a control technology of the steam power plant or a steam power station having the steam power plant. The control technology may be a control system which controls the steam power plant in its normal operation.

The steam power plant may be a plant in a steam power station operated with steam power. It may be a steam turbine of the steam power station, a steam process plant or any other plant which is operated with energy from steam.

According to a further design, it can be provided that, in the state regulator and/or the observer, by means of which the plurality of medium states of the steam are determined, a model of the control path of the superheater is used whose time delay is described by a time constant of the superheater which is formed by a ratio of a time constant of the superheater under full load to a load signal of the steam power plant.

It can be provided here also that, in the state regulator and/or the observer, a model of the control path of a measurement of the temperature of the steam at the outlet of a superheater is used of which the time delay is described by a time constant of the measurement.

Furthermore, the temperature of the steam at the outlet of the superheater can be determined as a controlled variable and/or a desired temperature of the steam at the inlet of the superheater can be determined as a manipulated variable.

Furthermore, the desired temperature of the steam at the inlet of the superheater can then be forwarded to a further regulator to control the temperature of the steam at the inlet of the superheater.

A setting of a control valve of spray-type desuperheater of a steam power station can be determined as a manipulated variable of the further regulator, via which a water quantity injected into the steam is controlled which determines the temperature of the steam at the inlet of the superheater.

The invention furthermore relates to a linear state regulator for controlling a temperature of steam for a steam power plant.

This linear state regulator is produced by transferring a feedback matrix of a linear quadratic state regulator which controls the temperature of the steam at an outlet of a superheater with feedback of a plurality of medium states of the steam in the superheater into a set of scalar equations, wherein the set of scalar equations is simplified in an analytically solvable manner by leaving out quadratic terms (linear state regulator), and by determining regulator amplifications in the linear state regulator by solving the simplified set of scalar equations.

The previously given description of advantageous designs of the invention contains numerous features which are reproduced in the individual subclaims in some cases combined into a plurality of features. However, the person skilled in the art will also appropriately consider these features individually and combine them into appropriate further combinations.

In particular, these features can in each case be combined individually and in any given suitable combination with the method according to the invention and/or with the device according to the respective independent claim.

BRIEF DESCRIPTION OF THE DRAWINGS

The invention is explained in detail with reference to example embodiments which are shown in the drawings.

In the drawings.

DETAILED DESCRIPTION OF INVENTION

Figure 1:
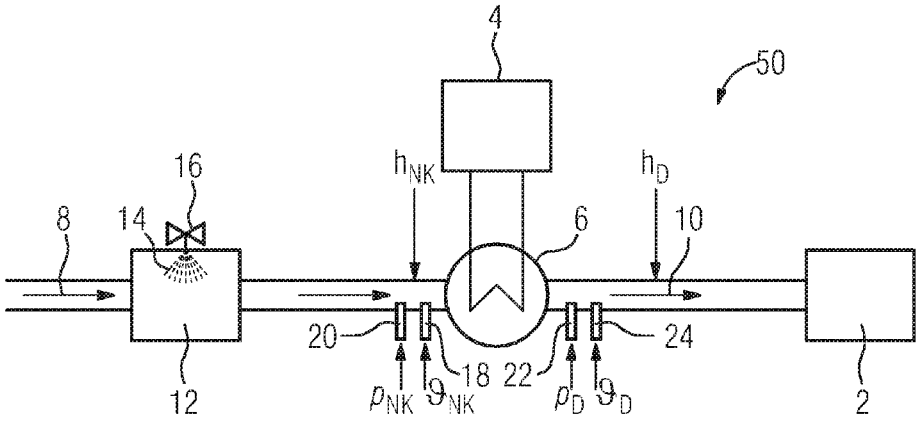
FIG. 1 shows a cut-out from a steam power station with a superheater.

FIG. 1 shows a schematic representation of a cut-out from a steam power station 50 with a steam turbine as a steam power plant 2, a boiler 4 which delivers heat to a superheater stage, e.g. of a multistage superheater 6, through which steam 8 flows.

Due to the absorption of heat, the steam 8 in the superheater 6 is superheated to fresh steam 10 and is then fed to the steam turbine 2.

In order to regulate the temperature of the steam 8, a spray-type desuperheater 12 is provided which injects water 14 into the steam 8 and thus cools the latter. The quantity of the injected water 14 is set by a control valve 16.

A temperature sensor 18 and a pressure sensor 20 measure the temperature $\vartheta_{NK}$ and the pressure $p_{NK}$ of the steam 8 upstream of the superheater 6, and a temperature sensor 22 and a pressure sensor 24 measure the fresh steam temperature $\vartheta_D$ and the fresh steam pressure $p_D$ of the fresh steam 10 downstream of the superheater 6.

Merely in order to make a clearer distinction, the steam 8 upstream of the superheater 6 is referred to below as steam 8 and the steam 10 downstream of the superheater 6 as fresh steam 10, wherein it is emphasized that, in the embodiment described below, the invention is obviously similarly applicable to steam which, in some instances, would not be referred to as fresh steam.

Figure 2:
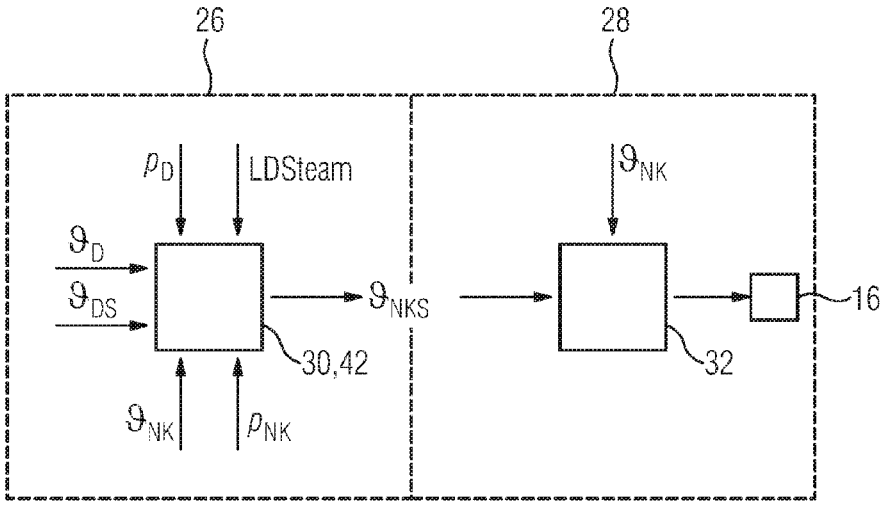
FIG. 2 shows a diagram of a control cascade.

FIG. 2 shows schematically a control cascade with an outer cascade 26 and an inner cascade 28.

The outer cascade 26 comprises a linear (state) regulator 30, the feedback matrix of which is determined in such a way that it has the control quality of a linear quadratic regulator (also referred to as a "simplified/modified" linear quadratic (state) regulator 30 or simply as a regulator 30 for short), to which the fresh steam temperature $\vartheta_D$ and its desired value $\vartheta_{DS}$, the fresh steam pressure $p_D$ and the temperature $\vartheta_{NK}$ and the pressure $p_{NK}$ of the steam 8 are fed as input variables.

A further input is the current load signal LDSteam, which is required for the load-dependent adaptation of the superheater time constant t_SH.

The fresh steam temperature $\vartheta_D$ downstream of the superheater 6 is the controlled variable of the regulator 30.

The desired temperature $\vartheta_{NKS}$ is output by the regulator 30 as the manipulated variable.

The desired temperature $\vartheta_{NKS}$ of the steam 8 is specified as a desired value to a control circuit 32 of the inner cascade 28. The temperature $\vartheta_{NK}$ of the steam 8 downstream of the spray-type desuperheater 12 is the controlled variable of the control circuit 32. The control circuit 32 has a setting of the control valve 16 of the spray-type desuperheater 12 as a manipulated variable and controls the temperature $\vartheta_{NK}$ by means of the water quantity 14 injected into the steam 8.

The regulator 30 does not act directly via a control element on the process, but transfers the desired value $\vartheta_{NKS}$ for the temperature downstream of the spray-type desuperheater 12 to the subordinate control circuit 32, with which it thus forms a cascade comprising the outer cascade 26 and the inner cascade 28.

The measured temperature $\vartheta_{NK}$ downstream of the spray-type desuperheater 12 is required by the regulator 30 as additional information, in the same way as the steam pressure $p_{NK}$ downstream of the spray-type desuperheater 12 and the fresh steam pressure $p_D$, since enthalpies are calculated internally from temperatures and pressures. A saturated steam limitation of the desired temperature value $\vartheta_{NKS}$ downstream of the desuperheater 12 is effected outside the regulator 30.

A time constant t_100 which describes the superheater dynamic response under full load is required for the parameterization of the regulator 30.

A change in the steam temperature $\vartheta_{NK}$ at the superheater inlet acts on the fresh steam temperature more less in such a way as described by a delay due to three first-order lag elements, each with a time constant t_100. Furthermore, a time constant t_MES is required, which describes the dynamic response of the fresh steam temperature measurement.

Figure 3:
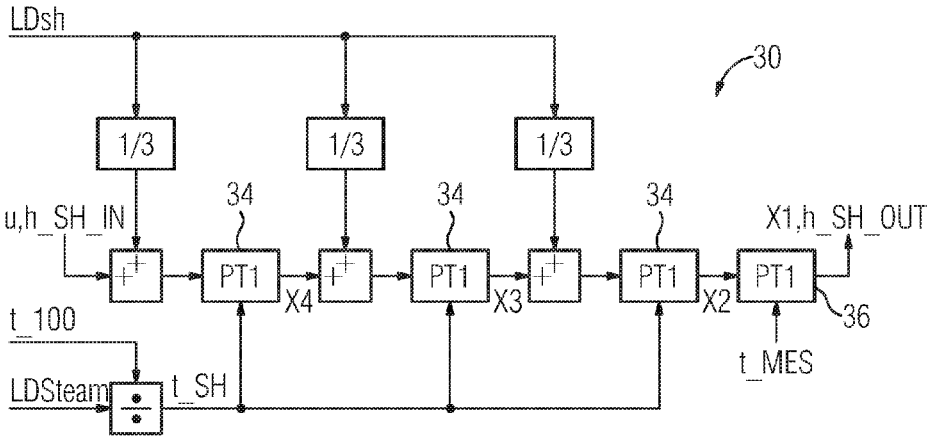
FIG. 3 shows a process model of the superheater.

FIG. 3 shows a model of the superheater path in the superheater 6, which consists of three first-order lag elements 34.

A first-order lag element 34 is understood below to mean a linear transmission element which has a first-order time delay.

The three first-order lag elements 34 map the transient response of a delay of the specific enthalpy $h_{NK}$ (h_SH_IN)

at the inlet of the superheater 6, i.e. downstream of the desuperheater 12 onto the specific enthalpy $h_D$ (h_SH_OUT) of the fresh steam 10.

The calculation is carried out here with enthalpies rather than temperatures, since the assumption of a linear behavior is thereby justified. The ratio of t_100 to the load signal LDSteam, with which the load-dependent dynamic response of the superheater 6 is approximated, serves as the time constant t_SH for the first-order lag elements 34.

With a lesser load, the flow rate of the steam 8 through the superheater 6 decreases and the transmission behavior becomes correspondingly more inert.

The heat supply LDsh from the boiler 4 results in a steam-side enthalpy increase via the superheater 6.

In the model, this is effected through addition in each case of one third of the specific heat supply at the input of each first-order lag element 34.

The measuring element delay in the fresh steam temperature measurement is modeled by a further first-order lag element 36 with the time constant t_MES.

The heat supply LDsh is reconstructed and connected accordingly in the regulator 30 by an employed (parameter) observer 42 via an observed state x5 (heat transfer factor).

The controlled variable of the regulator 30 is the temperature of the fresh steam $\vartheta_D$.

However, since the state regulator considered here is based on a model with enthalpies, the fresh steam temperature $\vartheta_D$ is converted by means of the fresh steam pressure $p_D$ and a steam table into the specific enthalpy $h_D$ or h_SH_OUT of the fresh steam 10. For the linear state regulator, $h_D$ or h_SH_OUT is therefore the controlled variable.

The state regulator considered is not intended to act directly on the spray-type desuperheater control valve 16.

The proven cascade structure is intended to be retained, wherein the subordinate control circuit 32, e.g. a PI controller, controls the temperature $\vartheta_{NK}$ downstream of the spray-type desuperheater 12 to a desired value $\vartheta_{NKS}$ by means of the control valve 16.

This desired value $\vartheta_{NKS}$ is therefore the manipulated variable for the outer cascade, which is formed by the state regulator. The desired value $\vartheta_{NKS}$ is in turn formed here by means of the pressure and the steam table from the enthalpy $h_{NKS}$ or h_SP_SH_IN.

The linear state regulator thus has the manipulated variable $h_{NKS}$ or h_SP_SH_IN.

A state regulator forms its regulator output as the weighted sum of the states of the path model.

In the case modeled here, these are the outputs of the four first-order lag elements 34, 36, denoted in FIG. 3 as $x_1$ to $x_4$, which, for the control, is the deviation of the states from their operating point.

For $x_1$ and $x_2$, this operating point is defined by the desired enthalpy value h_SP_SH_OUT, while for $x_3$ and $x_4$ it is ⅓ LDsh and ⅔ LDsh below it.

Thus, for example, the following is obtained for x1:

$$X1 = h_SH_\mathrm{OUT} - h_SP_SH_\mathrm{OUT}. \qquad \text{(Equation 1.1/1)}$$

In the stationary state, h_SH_OUT=h_SP_SH_OUT (x1=0), the enthalpy at the inlet of the superheater 6 is determined according to $$h_SH_\mathrm{IN} = h_SP_SH_\mathrm{OUT} - LDsh. \qquad \text{(Equation 1.1/2)}$$

From this, the following is obtained for the desired value of the enthalpy at the inlet of the superheater 6:

$$h_SP_SH_\mathrm{IN} = h_SP_SH_\mathrm{OUT} - LDsh + u, \qquad \text{(Equations 1.1/3)}$$

wherein u is the control variable in the case of deviations.

Figure 4:
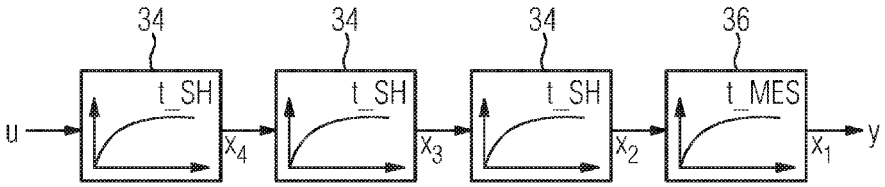
FIG. 4 shows a linear path model as a basis for a regulator design.

A chain of first-order lag elements 34, 36 is created, as shown in FIG. 4. In matrix notation, the chain of first-order lag elements 34, 36 is represented by a state space representation in the form:

$$\dot{x}(t) = Ax(t) + bu(t)$$

$$y(t) = c^T x(t) \qquad \text{(Equation 1.1/4, Equation 1.1/5)}$$

with the state vector $$x(t) = \begin{bmatrix} x_1(t) \\ x_2(t) \\ x_3(t) \\ x_4(t) \end{bmatrix}$$

and the system matrices $$A = \begin{bmatrix} \frac{-1}{\mathrm{t_MES}} & \frac{1}{\mathrm{t_MES}} & 0 & 0 \\ 0 & \frac{-1}{\mathrm{t_SH}} & \frac{1}{\mathrm{t_SH}} & 0 \\ 0 & 0 & \frac{-1}{\mathrm{t_SH}} & \frac{1}{\mathrm{t_SH}} \\ 0 & 0 & 0 & \frac{-1}{\mathrm{t_SH}} \end{bmatrix}, \qquad \text{(Equations 1.1/6)}$$

$$b = \begin{bmatrix} 0 \\ 0 \\ 0 \\ \frac{1}{\mathrm{t_SH}} \end{bmatrix} \text{ und } c^T = [1 \;\; 0 \;\; 0 \;\; 0].$$

In addition, $$t_SH = T_100/LD\mathrm{Steam}. \qquad \text{(Equation 1.1/7)}$$

The control circuit is described by the state feedback:

$$u = -k^T(X - xSP) \qquad \text{(Equation 1.2/1)}$$

with the control amplification $k^T = [k_1\ k_2\ k_3\ k_4]$ and xSP as the desired value state vector.

The regulator amplification $k^T$ is obtained by solving the matrix Riccati equation (MRDGL):

$$A^T P + PA - 1/r P \underline{b}\underline{b}^T P + Q = 0 \qquad \text{(Equation 1.2/2)}$$

where $$\underline{k}^T = 1/r \underline{b}^T P \qquad \text{(Equation 1.2/3)}$$

by minimizing the cost functional which evaluates the control quality and the control cost:

$$I = \int_{t=0}^{\infty} [x(t)Qx(t) + u(t)ru(t)]\,dt. \qquad \text{(Equation 1.2/4)}$$

Deviations of the states are weighted quadratically with the matrix Q, the quadratic control cost is weighted with r and integrated over time.

Since the control quality is obtained from a weighted quadratic sum of the states, it is possible to influence what is deemed to be "good control behavior" via the selection of the matrix Q.

It can be shown through simulations that Q can only be simply populated—with $$Q = \begin{pmatrix} Q1 & 0 & 0 & 0 \\ 0 & 0 & 0 & 0 \\ 0 & 0 & 0 & 0 \\ 0 & 0 & 0 & 0 \end{pmatrix}. \quad \text{Equation 1.2/5)}$$

Through transfer into a set of scalar equations, the following are obtained:

$$-2P11/t_MES-1/r(P41/t_SH)^2+Q1=0 \quad \text{(Equation 1.2/6a)}$$

$$P11/t_MES-P21/t_MES-P21/t_SH-P41P42/r/t_SH^2=0 \quad \text{(Equation 1.2/6b)}$$

$$P21/t_SH-P31/t_SH-P31/t_MES-P41P43/r/t_SH^2=0 \quad \text{(Equation 1.2/6c)}$$

$$P31/t_SH-P41/t_SH-P41/t_MES-P44P41/r/t_SH^2=0 \quad \text{(Equation 1.2/6d)}$$

$$2P21/t_MES-2P22/t_SH-P42^2/r/t_SH^2=0 \quad \text{(Equation 1.2/6e)}$$

$$P31/t_MES+P22/t_SH-2P32/t_SH-P42P43/r/t_SH^2=0 \quad \text{(Equation 1.2/6f)}$$

$$P41/t_MES+P32/t_SH-2P42/t_SH-P42P44/r/t_SH^2=0 \quad \text{(Equation 1.2/6g)}$$

$$2P32/t_SH-2P33/t_SH-P43^2/r/t_SH^2=0 \quad \text{(Equation 1.2/6h)}$$

$$P33/t_SH+P42/t_SH-2P43/t_SH-P43P44/r/t_SH^2=0 \quad \text{(Equation 1.2/6i)}$$

$$2P43/t_SH-2P44/t_SH-P44^2/r/t_SH^2=0. \quad \text{(Equation 1.2/6j)}$$

If it is taken into account that Pij<1, r>1 and t_SH<1, the result is that all quadratic terms (cf. terms in the form PabPcd/r/t_SH$^2$) in the set of scalar equations (1.2/6a-j) are small in relation to the other terms of these equations.

The set of scalar equations can thus be simplified by leaving out the quadratic terms without a substantial influence on the control quality, i.e. the simplified/"linear" regulator (still) has the control quality of a linear quadratic regulator:

$$-2P11/t_MES+Q1=0 \quad \text{(Equation 1.2/7a)}$$

$$P11/t_MES-P21/t_MES-P21/t_SH=0 \quad \text{(Equation 1.2/7b)}$$

$$P21/t_SH-P31/t_SH-P31/t_MES=0 \quad \text{(Equation 1.2/7c)}$$

$$P31/t_SH-P41/t_SH-P41/t_MES=0 \quad \text{(Equation 1.2/7d)}$$

$$2P21/t_MES-2P22/t_SH=0 \quad \text{(Equation 1.2/7e)}$$

$$P31/t_MES+P22/t_SH-2P32/t_SH=0 \quad \text{(Equation 1.2/7f)}$$

$$P41/t_MES+P32/t_SH-2P42/t_SH=0 \quad \text{(Equation 1.2/7g)}$$

$$2P32/t_SH-2P33/t_SH=0 \quad \text{(Equation 1.2/7h)}$$

$$P33/t_SH+P42/t_SH-2P43/t_SH=0 \quad \text{(Equation 1.2/7i)}$$

$$2P43/t_SH-2P44/t_SH=0. \quad \text{(Equation 1.2/7j)}$$

These equations 1.2/7a-j can be solved analytically:

$$\text{from (1.2/7a) } P11=t_MES\ Q^{1/2} \quad \text{(Equation 1.2/8a)}$$

$$\text{from (1.2/7b) } P21=P11t_SH(t_MES+t_SH) \quad \text{(Equation 1.2/8b)}$$

$$\text{from (1.2/7c) } P31=P21t_MES/(t_MES+t_SH) \quad \text{(Equation 1.2/8c)}$$

$$\text{from (1.2/7d) } P41=P31t_MES/(t_MES+t_SH) \quad \text{(Equation 1.2/8d)}$$

$$\text{from (1.2/7e) } P22=P21t_SH/t_MES \quad \text{(Equation 1.2/8e)}$$

$$\text{from (1.2/7f) } P32=P21t_SH/2/(t_MES+t_SH)+P22/2 \quad \text{(Equation 1.2/8f)}$$

$$\text{from (1.2/7g) } P42=P31t_SH/2/(t_MES+t_SH)+P32/2 \quad \text{(Equation 1.2/8g)}$$

$$\text{from (1.2/7h) } P33=P32 \quad \text{(Equation 1.2/8h)}$$

$$\text{from (1.2/7i) } P43=(P33+P42)/2 \quad \text{(Equation 1.2/8i)}$$

$$\text{from (1.2/7j) } P44=P43. \quad \text{(Equation 1.2/8j)}$$

This therefore results in the following for Equation 1.2/3:

$$\underline{k}^T=1/r/t_SH[P41\ P42\ P43\ P44]=[k1\ k2\ k3\ k4]. \quad \text{(Equation 1.2/9)}$$

With the stationary solution, in which h_SH_OUT=h_SP_SH_OUT, the following is obtained for xSP:

$$x1SP=0, \quad \text{(cf. Equation 1.1/1)(Equation 1.2/10a)}$$

$$x2SP=0 \quad \text{(Equation 1.2/10b)}$$

$$x3SP=x2SP-LDsh/3=-LDsh/3 \quad \text{(Equation 1.2/10c)}$$

$$x4SP=x3SP-LDsh/3=-2LDsh/3 \quad \text{(Equation 1.2/10d).}$$

The following is then obtained for u according to Equation 1.2/1:

$$u=-k1(x1-x1SP)-k2(x2-x2SP)-k3(x3-x3SP)-k4(x4-x4SP) \quad \text{(Equation 1.2/11)}$$

and therefore:

$$u=-k1x1-k2x2-k3x3-k4x4-(k3/3+2k4/3)LDsh. \quad \text{(Equation 1.2/12)}$$

The required enthalpy at the inlet of the superheater 6 is obtained according to Equation 1.1/3 with:

$$h_SP_SH_IN=-k1x1-k2x2-k3x3-k4x4-(k3/3+2k4/3)LDsh+h_SP_SH_OUT-LDsh \quad \text{(Equation 1.2/13)}$$

and therefore $$h_SP_SH_IN=-k1x1-k2x2-k3x3-k4x4-k5LDsh+h_SP_SH_OUT, \quad \text{(Equation 1.2/14)}$$

where $$k5=1+k3/3+2k4/3 \quad \text{(Equation 1.2/15).}$$

The required temperature at the inlet of the superheater 6 $\vartheta_{NKS}$ or T_SP_SH_IN can thus be determined by:

1.) Determination of t_SH with predefined or predefinable values for t_100 and LDSteam according to Equation 1.1/7, 2.) Determination of the Pij with predefined or predefinable values for t_MES and Q1 according to Equation 1.2/8, 3.) Determination of the regulator amplification $k^T$ with a predefined or predefinable value for r according to Equation 1.2/9, 4.) Determination of k5 according to Equation 1.2/15, 5.) Determination of h_SP_SH_IN with a predefined or predefinable value for h_SP_SH_OUT according to Equation 1.2/14, 6.) Determination of T_SP_SH_IN from h_SP_SH_IN and p_SH_IN using the steam table.

Figure 5:
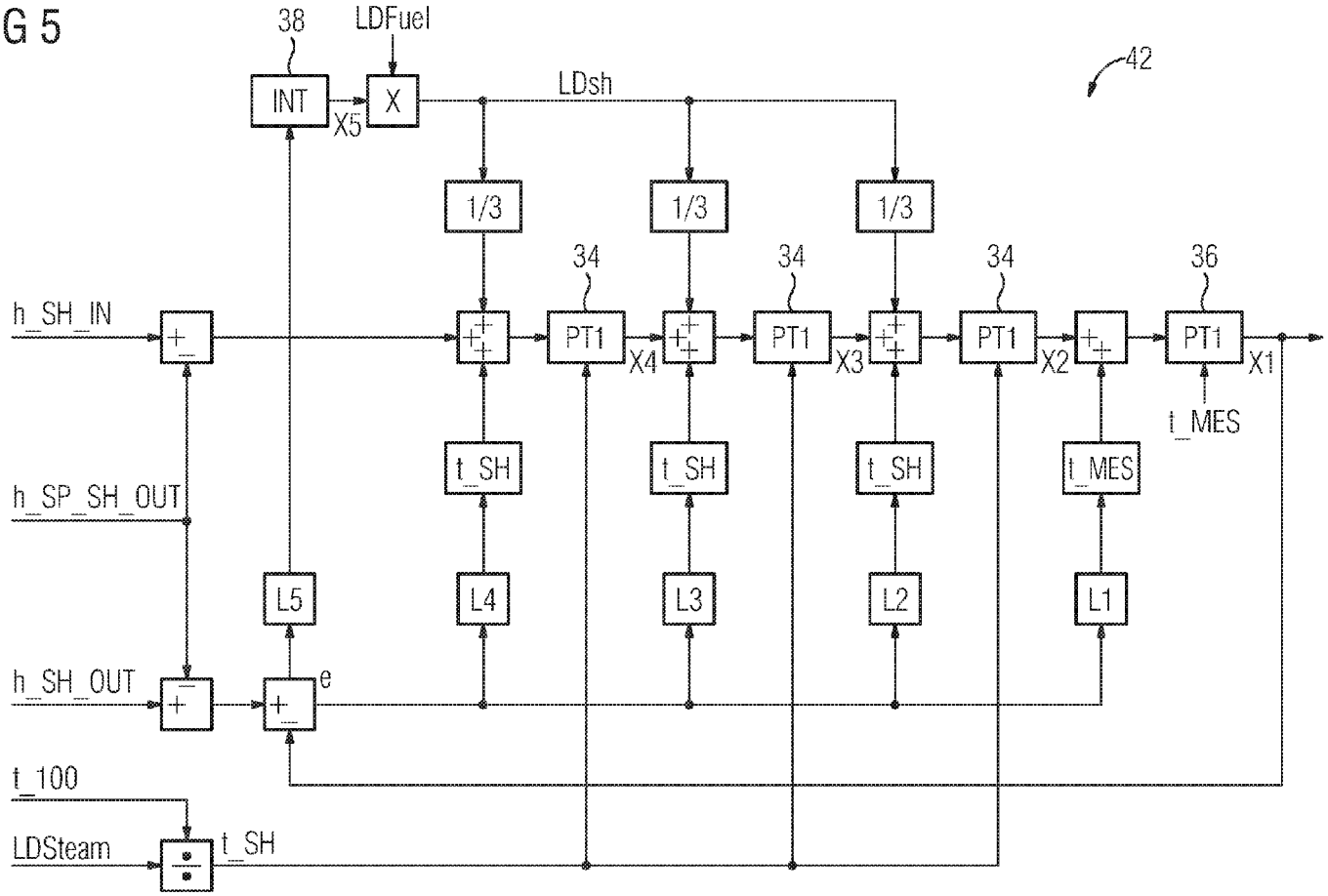
FIG. 5 shows a structure of an observer.

The observer 42, also referred to as the parameter observer, is described below. FIG. 5 shows the structure of the observer 42.

The state regulator forms its regulator output as the weighted sum of the path states. In the case modeled here (cf. FIG. 3), these are the outputs of the four first-order lag elements 34, 36.

However, since no measurements of enthalpies occur along the superheater 6, these must be reconstructed using an observer.

The path states are reconstructed by calculating a dynamic path model parallel to the real process.

The deviation between measurement values from the process and the corresponding values which are determined with the path model is referred to as the observer error e. The individual states of the path model are in each case corrected by a weighted observer error, as a result of which the latter is stabilized. The weightings are referred to as the observer amplification $L_1$-$L_5$.

In this case, the specific enthalpy $h_D$ of the fresh steam, which is calculated from the fresh steam temperature $\vartheta_D$ and the fresh steam pressure $p_D$, serves as the "measurement parameter".

An observer model 42 slightly modified in comparison with FIG. 3 is used as the path model.

The absolute specific enthalpies are not selected as the state variables, but rather their deviation from the desired enthalpy value $h_{DS}$ (h_SP_SH_OUT) for the fresh steam 10, just as the states were previously defined in the description of the state regulator (cf. Equations 1.1/1 and 1.1/3).

One input into the path model is the specific enthalpy $h_{NK}$ (h_SH_IN) downstream of the desuperheater 12. It is formed directly from the measurement value of the temperature $\vartheta_{NK}$ downstream of the desuperheater 12 and the associated pressure $p_{NK}$.

Furthermore, the observer model is extended by an estimated state $x_5$, which is supplied by an integrator 38 into the path model. The only connection to the integrator input is the observer error weighted with $L_5$ for the correction.

This estimated state x5 describes the proportion of a total fuel power or the fuel mass flow LDFuel that is actually used for the heating (LDsh) of the steam 8 flowing through the superheater 6.

The system equations of the observer model—without the feedback by the observer amplifications—are given by:

$$\dot{x}(t)=A_O x(t)+b_O u(t)$$

$$y(t)=c_O^T x(t) \qquad \text{(Equation 2.1/1 and Equation 2.1/2)}$$

where $$\underline{x}(t)=\begin{pmatrix} x1(t) \\ x2(t) \\ x3(t) \\ x4(t) \\ x5(t) \end{pmatrix}.$$

The system matrices of the observer model—without the feedback by the observer amplifications—are given by $$A_O=\begin{bmatrix} \frac{-1}{\text{t_MES}} & \frac{1}{\text{t_MES}} & 0 & 0 & 0 \\ 0 & \frac{-1}{\text{t_SH}} & \frac{1}{\text{t_SH}} & 0 & \frac{LDFuel}{3\text{t_SH}} \\ 0 & 0 & \frac{-1}{\text{t_SH}} & \frac{1}{\text{t_SH}} & \frac{LDFuel}{3\text{t_SH}} \\ 0 & 0 & 0 & \frac{-1}{\text{t_SH}} & \frac{LDFuel}{3\text{t_SH}} \\ 0 & 0 & 0 & 0 & 0 \end{bmatrix}, \qquad \text{(Equations 2.1/3).}$$

$$b_O=\begin{bmatrix} 0 \\ 0 \\ 0 \\ \frac{1}{\text{t_SH}} \\ 0 \end{bmatrix} \text{ and } c^T=[1\ \ 0\ \ 0\ \ 0\ \ 0].$$

The subscript O stands for the observer 42.

In order to reconstruct the path states ($x_1$ to $x_4$) and the state x5 or combustion parameter or heat proportion factor ($x_5$), the observer 42 or parameter observer 42 proposed here requires only measurement values or variables derived from measurement values—the specific enthalpy upstream ($h_{NK}$, h_SH_IN) and downstream ($h_D$, h_SH_OUT) of the superheater 6.

No control signals of a regulator are required, since it contains no model of the control element dynamics. An observer implemented in the control technology system can thus run concurrently (online) at any time, regardless of the control structure used, i.e. a deactivation of the state regulator or the temporary replacement with a different control structure does not influence the observer.

The observer amplification $L^T$ is obtained when the matrix Riccati equation (MRDGL) is solved as follows:

$$A_O P_O+P_O A_O^T-1/r P_O \underline{c}\underline{c}^T P_O+Q_O=0 \qquad \text{(Equation 2.2/1)}$$

with $$\underline{L}^T=1/r\underline{c}^T P_O. \qquad \text{(Equation 2.2/2)}$$

It can be shown through simulations that $Q_O$ is simply populated—with $$Q_O=\begin{pmatrix} 1 & 0 & 0 & 0 & 0 \\ 0 & 1 & 0 & 0 & 0 \\ 0 & 0 & 1 & 0 & 0 \\ 0 & 0 & 0 & 1 & 0 \\ 0 & 0 & 0 & 0 & 100 \end{pmatrix} \qquad \text{(Equation 2.2/3)}$$

Due to the structure of the matrix $A_O$, a simplification of this type, as in the case of the state regulation, is not possible here.

The associated matrix Riccati equation $$-dP_O/dt=A_O P_O+P_O A_O^T-1/r P_O \underline{c}\underline{c}^T P_O+Q_O=0 \qquad \text{(Equation 2.2/4)}$$

must be used, wherein a stable integration of Equation 2.2/4 is possible. In the stationary state of Equation 2.2/4, the matrix $P_O$ is obviously a solution of Equation 2.2/1 also.

The observer amplifications $L^T$ are thus ultimately obtained with the stationary solution $P_O$ as a function of the independent parameters t_SH, t_MES, r and LDFuel.

Investigations of the dependence of the individual observer amplifications $L^T$ on the parameters t_SH, t_MES, r and LDFuel have shown that the observer amplifications for the states, L1-L4, are similar to one another, but dissimilar from the observer amplification for the combustion parameter L5.

It is furthermore understandable that, in the case of deviations of the model from the true process behavior, it is in fact irrelevant how the correction of the states is distributed among the states.

Consequently, the observer amplifications L1-L4 are in each case approximated by the same value L14.

Instead of having to calculate a plurality of "state observer amplifications", L1-L4, along with the observer amplification L5, only an associated amplification L14 therefore now needs to be determined.

Furthermore, these state amplifications L14 and L5 which are now to be calculated are approximated by approximation functions/curves which describe the dependence of the observer amplifications on the parameters t_SH, t_MES, r and LDFuel.

For this purpose, the observer amplifications are initially (precisely) determined offline by solving the matrix Riccati equation. These precise functions/curves for the observer amplifications are then mapped/simulated through simple analytical approximations (linear, power and/or root functions). These approximations are then used online for the observer amplifications.

The following is obtained here for the approximation of L14:

$$L14=0.0226*t_SH\hat{}(-0.335)*(156+t_MES)*r\hat{}(-0.431)*(0.424+LD\text{Fuel}). \quad \text{(Equation 2.2/8)}$$

The observer amplification L5 is approximated by $$L5=10/\text{SQRT}(r). \quad \text{(Equation 2.2/9)}$$

The states x1 to x5 necessary for the state regulator 30 can thus be determined by:

1.) Determination of L14 with predefined or predefinable values for t_SH, t_MES, r and LDFuel according to Equation 2.2/8, 2.) Define L1=L2=L3=L4=L14, 3.) Determination of L5 with predefined or predefinable values for r according to Equation 2.2/9, 4.) Determination of h_SH_IN from t_SH_IN and p_SH_IN using the steam table, 5.) Determination of h_SH_OUT from t_SH_OUT and p_SH_OUT using the steam table, 6.) Determination of h_SP_SH_OUT from t_SP_SH_OUT and p_SH_OUT using the steam table, 7.) Dynamic determination of the states $x_1$ to $x_5$ using the observer 42 according to FIG. 5.

The observer 42 shown in FIG. 5 thus dynamically supplies the states $x_1$ to $x_4$ and the state $x_5$ or the combustion parameter $x_5$, which are then used in the state regulator 30.

Although the invention has been illustrated and described in greater detail by the preferred example embodiments, the invention is not limited by the disclosed examples, and other variations can be derived herefrom by the person skilled in the art without departing from the protective scope of the invention.

REFERENCE NUMBER LIST

2 Steam power plant, steam turbine
4 Boiler
6 Superheater
8 Steam
10 Fresh steam
12 Spray-type desuperheater
14 Water
16 Control valve
18 Temperature sensor
20 Pressure sensor
22 Temperature sensor
24 Pressure sensor
26 Cascade
28 Cascade
30 (linear) (state) regulator, "simplified/modified" linear quadratic (state) regulator
32 Control circuit
34 First-order lag element
36 First-order lag element
38 Integrator
42 Observer
50 Steam power station, steam power station plant
u Input variable, steam temperature at the inlet of the superheater, control cost
y Output variable, steam temperature at the outlet of the superheater
xi State (variable), steam temperature at the position i in the superheater
x5 Combustion parameter, heat transfer factor
e Observer error
L1, L2, L3, L4. L14 Observer amplification for the medium states
L5 Observer amplification for the combustion parameter or the heat transfer factor
h_SH_IN, $h_{NK}$ Specific enthalpy at the inlet of the superheater
h_SP_SH_IN, $h_{NKS}$ Desired value of the enthalpy at the inlet of the superheater
h_SH_OUT, $h_D$ Enthalpy of the fresh steam or at the outlet of the superheater
h_SP_SH_OUT, $h_{DS}$ Desired value of the enthalpy of the fresh steam or at the outlet of the superheater
LDSteam Load signal
LDsh Heat supply from the boiler
LDFuel Fuel mass flow
$\vartheta_{NK}$, T_SH_IN Steam temperature at the inlet of the superheater
$\vartheta_{NKS}$, T_SP_SH_IN Desired steam temperature at the inlet of the superheater
$\vartheta_D$, T_SH_OUT Fresh steam temperature
$\vartheta_{DS}$, T_SP_SH_OUT Desired fresh steam temperature
$P_{NK}$, p_SH_IN Fresh steam pressure at the inlet of the superheater
$p_D$, p_SP_SH_OUT Fresh steam pressure or steam pressure at the outlet of the superheater
t_MES Time constant of the measurement
t_SH Time constant of the superheater
t_100 Time constant of the superheater under full load

The invention claimed is:

1. A method for controlling a temperature of steam for a steam power plant having a superheater, comprising:

controlling via a state regulator the temperature of the steam at an outlet of a superheater with feedback of a plurality of medium states of the steam in the superheater of the steam power plant which generates electricity, wherein the state regulator is initially based on a linear quadratic regulator (LQR) for state control;

transferring a feedback matrix of the state regulator into a set of scalar equations, wherein the set of scalar equations is simplified in an analytically solvable manner by leaving out all quadratic terms and integrations of a matrix Riccati equation;

determining regulator amplifications in the state regulator by solving the simplified set of scalar equations;

analytically approximating the regulator amplifications; and determining the plurality of medium states of the steam by an observer, the observer includes a plurality of observer weights for the plurality of medium states with the plurality of observer weights set to an identical value, wherein the state regulator is simplified into a linear regulator, the feedback matrix of which is determined in such a way that it has the control quality of the linear quadratic regulator (LQR) and computational simplicity of the linear regulator.

2. The method of claim 1, further comprising calculating a combustion parameter wherein the combustion parameter is an additional observer weight of the observer.

3. The method of claim 2, further comprising determining approximation functions for the plurality of observer weights which describe dependence of an individual observer weight on parameters.

4. The method of claim 3, wherein precise observer weights are initially determined offline and the precise observer weights are then simulated by the approximation functions, said approximation functions then being usable online.

5. The method of claim 1, wherein the state regulator is equipped with a parameter observation.

6. The method of claim 5, wherein in the parameter observation, a combustion parameter is observed which describes a proportion of a total fuel power that is actually used to heat the steam flowing through the superheater wherein the combustion parameter is an additional observer weight.

7. The method of claim 6, wherein the combustion parameter is a heat transfer factor.

8. The method of claim 1, wherein enthalpies of the steam are used as the plurality of observer weights for the plurality of medium states and/or that deviations of absolute enthalpies from desired enthalpy values are used as the plurality of observer weights for the plurality of medium states.

9. The method of claim 1, wherein a mathematical regulator problem is linearized by a conversion of temperature measurement values and desired temperature values into enthalpies.

10. The method of claim 1, wherein the temperature of the steam at the outlet of the superheater is determined as a controlled variable, and/or a desired temperature of the steam at an inlet of the superheater is determined as a manipulated variable.

11. The method of claim 10, wherein the desired temperature of the steam at the inlet of the superheater is forwarded to a further regulator to control a temperature of the steam at the inlet of the superheater.

12. The method of claim 11, wherein a setting of a control valve of a spray-type desuperheater of a steam power station is determined as a manipulated variable, via which a water quantity injected into the steam is controlled, said water quantity defining the temperature of the steam at the inlet of the superheater.

13. The method of claim 1, wherein the plurality of medium states of the steam describe temperatures or enthalpies of the steam along the superheater.

14. The method of claim 1, wherein the observer operates independently from the state regulator.

15. The method of claim 1, wherein the plurality of observer weights being a function of an enthalpy along the superheater.

16. A device for controlling a temperature of steam for a steam power plant having a superheater, comprising:

a state regulator, implemented in both software and hardware, which controls the temperature of the steam at an outlet of the superheater with feedback of a plurality of medium states of the steam in the superheater of the steam power plant which generates electricity, wherein the state regulator is initially based on a linear quadratic regulator (LQR) for state control; and a feedback matrix being transferred into a set of scalar equations, wherein the set of scalar equations is simplified in an analytically solvable manner by leaving out all quadratic terms and integrations of a matrix Riccati equation, wherein the state regulator is simplified into a linear regulator, wherein regulator amplifications in the state regulator are determined by solving the simplified set of scalar equations and analytically approximating the regulator amplifications and wherein the feedback matrix of which is determined in such a way that it has the control quality of the linear quadratic regulator (LQR) and computational simplicity of the linear regulator and the plurality of medium states of the steam are determined by an observer, wherein the observer includes a plurality of observer weights for the plurality of medium states with the plurality of observer weights set to an identical value.

17. The device of claim 16, wherein the state regulator is equipped with a parameter observation; and wherein in the parameter observation, a combustion parameter is observed which describes a proportion of a total fuel power that is actually used to heat the steam flowing through the superheater wherein the combustion parameter is an additional observer weight.

18. A method for controlling a temperature of steam for a steam power plant having a superheater, comprising:

controlling via a state regulator the temperature of the steam at an outlet of a superheater with feedback of a plurality of medium states of the steam in the superheater of the steam power plant which generates electricity, wherein the state regulator is initially based on a linear quadratic regulator (LQR) for the state control;

transferring a feedback matrix of the state regulator into a set of scalar equations, wherein the set of scalar equations is simplified in an analytically solvable manner by leaving out all quadratic terms and integrations;

determining regulator amplifications in the state regulator by solving the simplified set of scalar equations;

analytically approximating the regulator amplifications;

determining the plurality of medium states of the steam by an observer, the observer includes a plurality of observer weights for the plurality of medium states with the plurality of observer weights set to an identical value, wherein the state regulator is simplified into a linear regulator and equipped with a parameter observation, the feedback matrix of which is determined in such a way that it has the control quality of the linear quadratic regulator (LQR) and computational simplicity of the linear regulator; and observing, in the parameter observation, a combustion parameter which describes a proportion of a total fuel power that is actually used to heat the steam flowing through the superheater wherein the combustion parameter is an additional observer weight.

* * * * *